US009421684B1

(12) United States Patent
Walcher

(10) Patent No.: US 9,421,684 B1
(45) Date of Patent: Aug. 23, 2016

(54) TIRE ATTACHABLE TRAY

(71) Applicant: Rex Walcher, Henryetta, OK (US)

(72) Inventor: Rex Walcher, Henryetta, OK (US)

( * ) Notice: Subject to any disclaimer, the term of this patent is extended or adjusted under 35 U.S.C. 154(b) by 0 days.

(21) Appl. No.: 14/822,768

(22) Filed: Aug. 10, 2015

(51) Int. Cl.
*A47B 23/00* (2006.01)
*B25H 1/00* (2006.01)
*B25H 1/04* (2006.01)

(52) U.S. Cl.
CPC ..... *B25H 1/0007* (2013.01); *B25H 1/04* (2013.01)

(58) Field of Classification Search
CPC ..... B60N 3/002; B60N 3/005; B60N 3/007; B60N 3/001; B25H 1/0007; B25H 1/04
USPC ..... 108/42, 44, 47
See application file for complete search history.

(56) References Cited

U.S. PATENT DOCUMENTS 2,692,174 A * 10/1954 Whitehead ..... A47C 7/68 108/157.11
2,797,973 A * 7/1957 Culpepper ..... A47C 7/68 108/157.11
3,269,555 A * 8/1966 Henderson ..... B60N 3/08 108/47
3,633,519 A * 1/1972 Nichol ..... A47C 9/10 108/159
4,309,009 A * 1/1982 Mitchell ..... B25H 3/06 211/72
4,341,304 A * 7/1982 Diller ..... B25H 3/06 108/44
4,403,806 A * 9/1983 Stephen ..... A47C 15/004 108/44
4,782,916 A 11/1988 Hays
4,800,987 A 1/1989 Liles
4,919,229 A 4/1990 Wells
4,947,961 A 8/1990 Dudley
5,111,909 A 5/1992 Liu
5,133,429 A 7/1992 Densley
5,354,027 A * 10/1994 Cox ..... A47B 3/0815 108/115
5,678,796 A * 10/1997 James ..... E04H 6/04 135/88.1
5,909,922 A * 6/1999 Dugas ..... A47C 7/70 108/43
6,038,984 A * 3/2000 Freitag ..... B25H 3/06 108/44
6,082,270 A * 7/2000 Zerger ..... B60N 3/001 108/42
6,550,578 B1 4/2003 Law et al.
D481,282 S * 10/2003 Kitchen ..... D3/318
6,767,023 B1 7/2004 Nicholson
7,207,438 B2 * 4/2007 Lieffring ..... B25H 3/06 108/143
8,061,952 B1 * 11/2011 Scherden ..... B60B 30/02 280/79.4
8,235,340 B2 * 8/2012 Carnevali ..... F16B 2/065 248/231.71
8,419,143 B2 * 4/2013 Shin ..... F25D 25/02 312/408
8,672,298 B2 * 3/2014 Hsieh ..... B60S 9/08 254/418
8,915,197 B2 * 12/2014 Raml ..... A47B 5/00 108/152
2015/0197220 A1 * 7/2015 Lusty ..... B60S 9/22 254/420

* cited by examiner

*Primary Examiner* — Hanh V Tran
(74) *Attorney, Agent, or Firm* — The Keys Law Firm PLLC

(57) ABSTRACT

A tire attachable tool tray for providing a selectively deployable shelf surface within arms reach of the hood of a vehicle includes a generally planar surface shelf section attached to a locking plate and a support plate, each of which define rigid planar bodies which extend perpendicularly from the bottom of the shelf section. Integral with the locking plate is a locking mechanism which is defined by two spring loaded locking legs. In this regard, a user can move the locking assembly into an engaged position in which it is primed to lock onto a tire through the application of manual force on the handle and then lock the assembly on a tire by placing a tire between the locking plate and support plate and removing the manual force keeping the locking mechanism in the engaged position.

2 Claims, 3 Drawing Sheets

TIRE ATTACHABLE TRAY

BACKGROUND OF THE INVENTION

1. Field of the Invention

This invention relates generally to maintenance accessories and, more particularly, to a tray attachment adapted for placement on a tire with a spring loaded locking mechanism.

2. Description of the Prior Art

A well known issue for automobile mechanics and others who work on vehicles, particularly under the hood (generally referred to herein as "mechanics"), is that there is generally no place to keep tools during the course of such work. When tools are attempted to be kept within arms reach, it is not uncommon for them to fall into the engine block or other hard to reach area in the vehicle. On the other hand, if the tools are kept in a tool box positioned nearby on a floor or shelf, the mechanic may end up wasting time by being forced to repeated stop work and walk over to the nearby tool box to retrieve desired.

As such, there remains a need for a tire attachable tool tray would provide a selectively deployable shelf suitable to hold tools within arms reach of one working under a vehicle's hood. It would be helpful if such a tire attachable tool tray included a spring loaded locking mechanism which enables the tray to be selectively set in a fixed position so as to prevent tools from sliding off. It would be additionally desirable for such a tire attachable tool tray to include a handle which was integrated with the locking mechanism to allow a user to easily set and release the lock.

The Applicant's invention described herein provides for a tire attachable tool tray adapted to allow a user to selectively deploy a fixed tool shelf on the tire of a vehicle. The primary components in Applicant's tire attachable tool tray are a shelf section, a locking plate, a support plate, and a locking mechanism. When in operation, the tire attachable tool tray enables a user to store tools desired to be used while working under a vehicle hood on a sold, flat surface that is generally within arms reach. As a result, many of the limitations imposed by prior art structures are removed.

SUMMARY OF THE INVENTION

A tire attachable tool tray for providing a selectively deployable shelf surface within arms reach of the hood of a vehicle. The tire attachable tool tray includes a rigid, generally planar surface shelf section attached to a locking plate and a support plate, each of which define rigid planar bodies which extend perpendicularly from the bottom of the shelf section. Integral with the locking plate is a locking mechanism which is defined by two spring loaded locking legs which pass the locking plate, being attached to a single handle on one side and having a padded end on the other side. In this regard, a user can move the locking assembly from a disengaged, resting position to an engaged position in which it is primed to lock onto a tire through the application of manual force on the handle. Furthermore, a user can lock the assembly on a tire by placing a tire between the locking plate and support plate with the locking mechanism in the engaged position and removing the manual force keeping the locking mechanism in the engaged position.

It is an object of this invention to provide a tire attachable tool tray which provides a selectively deployable shelf suitable to hold tools within arms reach of one working under a vehicle's hood.

It is another object of this invention to provide a tire attachable tool tray which includes a spring loaded locking mechanism which enables the tray to be selectively set in a fixed position so as to prevent tools from sliding off.

It is yet another object of this invention to provide a tire attachable tool tray which includes a handle which was integrated with the locking mechanism to allow a user to easily set and release the lock.

These and other objects will be apparent to one of skill in the art.

DETAILED DESCRIPTION OF THE INVENTION

Figure 1:
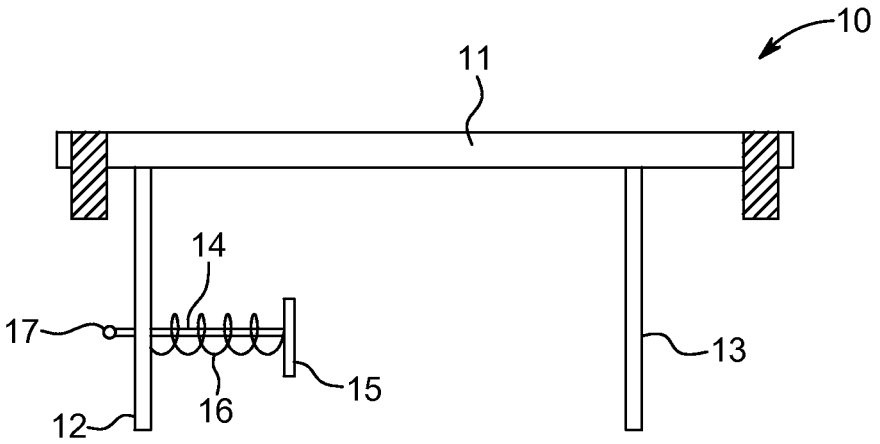
FIG. 1 is a right side elevational view of a tire attachable tool tray built in accordance with the present invention having its locking mechanism in a disengaged position.

Referring now to the drawings and in particular FIGS. 1, 2, 3, 4, and 5, a tire attachable tool tray 10 is shown having a shelf section 11 attached to a locking plate 12 and a support plate 13. In the preferred embodiment, the shelf section 11 defines a rigid plate measuring 24"×18"×2" and which provides a generally planar surface on which tools or other items can be placed. In some embodiments, the top surface of the shelf section 11 is completely flat while in other embodiments, the top surface of the shelf section 11 defines a shallow basin shape which includes a depressed central holding area which is lower than the edges of the shelf section 11, thereby creating a wide flat bottom with relatively tall raised edges that to act as an elevated rim which can prevent items from inadvertently sliding off the shelf section 11.

The locking plate 12 and the support plate 13 each define rigid planar bodies which extend perpendicularly from the bottom of the shelf section 11. In one embodiment, the locking plate 12 and the support plate 13 extend 12" down from the shelf section 11. Integral with the locking plate 12 is a locking mechanism which is defined by two spring loaded locking legs 14 which pass through apertures in the locking plate 12, each having a padded end 15 and spring 16 on one side of the locking plate and being attached to a single handle 17 on the other side of the locking plate 12. In the absence of manual pressure or a tire, the locking mechanism remains in a disengaged position with the handle 17 adjacent to the locking plate, the padded ends 15 of the respective locking legs 14 full extended away from the locking plate 12, and the springs 16 uncoiled (as illustrated in FIG. 1).

Figure 2:
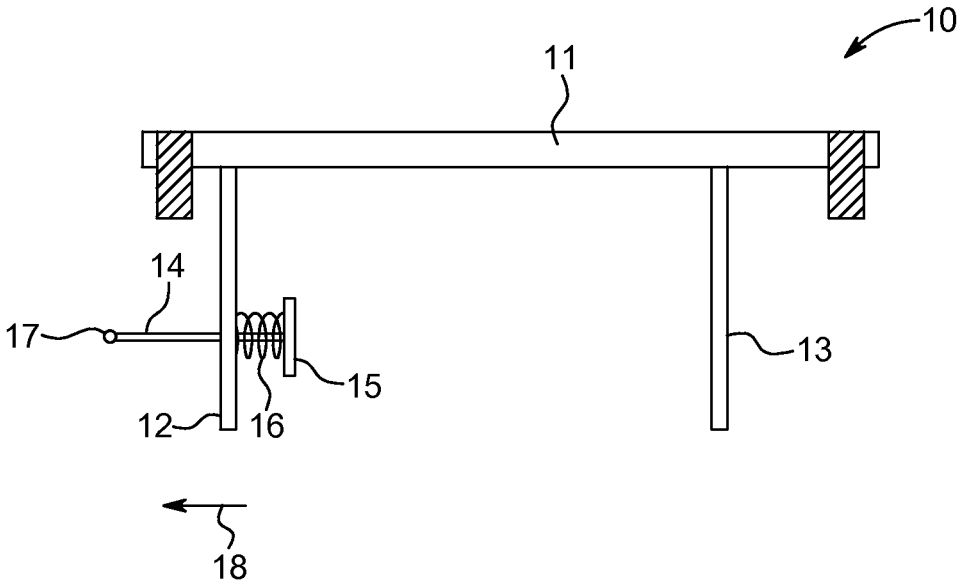
FIG. 2 is a right side elevational view of a tire attachable tool tray built in accordance with the present invention having its locking mechanism in an engaged position.
Figure 3:
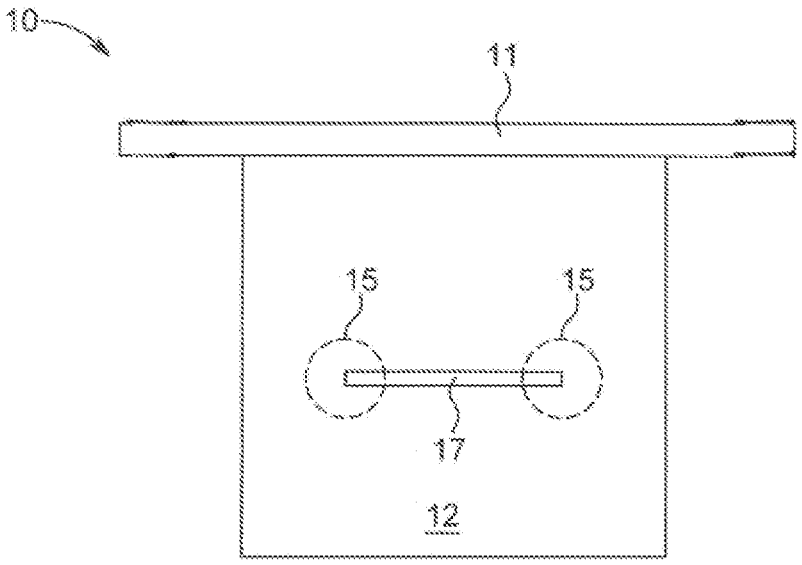
FIG. 3 is a front side elevational view of a tire attachable tool tray built in accordance with the present invention.
Figure 4:
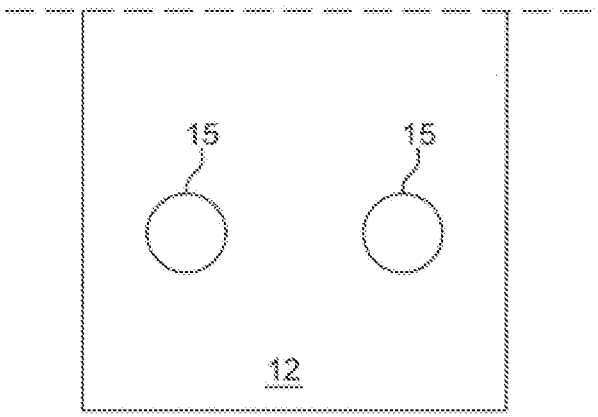
FIG. 4 is a partial back side elevational view of a locking plate of the tire attachable tool tray built in accordance with the present.

To prepare the tire attachable tool tray 10 to be locked on a tire 20, a user would apply manual force in an opening direction 18 on the handle 17, forcing the locking mechanism into an engaged position with handle 17 pulled away from the locking plate 12, the padded ends 15 adjacent to the locking plate 12 and springs 16 coiled (as illustrated in FIG. 2).

Figure 5:
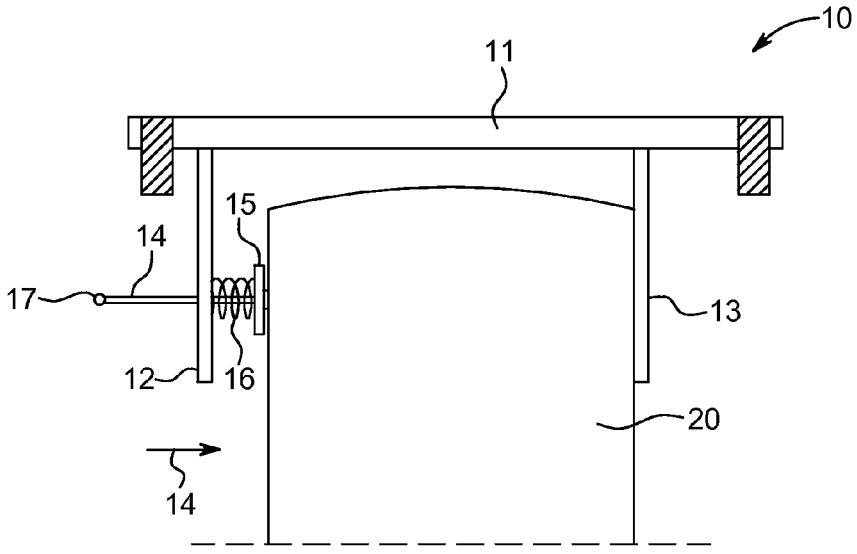
FIG. 5 is a right side elevational view of a tire attachable tool tray built in accordance with the present invention in place on a tire.

To lock the tire attachable tool tray 10 onto a tire 20, the tire attachable tool tray 10 is placed over a tire with the locking mechanism in the engaged position (through the continued application of manual force in the opening direction 18) and the tire 20 positioned between the locking plate 12 and the support plate 13. The manual force in the opening direction 18 is then removed and the springs 16 force the handle 17, locking legs 14 and padded ends 15 assembly in a locking direction 19 until the tire 20 is wedged between the padded ends 15 and the support plate 13 (as illustrated in FIG. 5.

To remove the tire attachable tool tray 10 from a tire 20, the handle is pulled in the opening direction 18 to un-wedge the tire 20 from between the padded ends 15 and the support plate 13, allowing the tire attachable tool tray 10 to be lifted off the tire 20.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A tire attachable tool tray, comprising:

a rigid shelf section defining a generally planar surface having a top surface suitable for holding tools and a bottom surface;

a rigid support plate fixedly attached to said shelf section, extending perpendicularly from the bottom surface of said shelf section; and a locking plate fixedly attached to said shelf section, extending perpendicularly from the bottom surface of said shelf section and in a parallel alignment with the support plate; and a locking mechanism integral with said locking plate, wherein said locking mechanism is defined by two spring loaded locking legs passing through apertures in the locking plate and connected to a single handle which enables the simultaneous application of manual force to both locking legs; and said locking mechanism positioned to move perpendicularly relative to said locking plate and support plate and adapted to selectively wedge a conventional tire against the support plate with the locking legs contacting the conventional tire in two distinct locations.

2. The tire attachable tool tray of claim 1, wherein the two spring loaded locking legs each include a padded end and a spring on one side of the locking plate and are attached to opposing sides of the handle on the other side of the locking plate.

* * * * *